US009661908B2

(12) United States Patent
Mayer

(10) Patent No.: US 9,661,908 B2
(45) Date of Patent: May 30, 2017

(54) HOLDING DEVICE FOR CARDS AND/OR BANKNOTES

(71) Applicant: Frank F. E. Mayer, Bad Duerkheim (DE)

(72) Inventor: Frank F. E. Mayer, Bad Duerkheim (DE)

( * ) Notice: Subject to any disclaimer, the term of this patent is extended or adjusted under 35 U.S.C. 154(b) by 211 days.

(21) Appl. No.: 14/355,683

(22) PCT Filed: Nov. 2, 2012

(86) PCT No.: PCT/EP2012/004565

§ 371 (c)(1),
(2) Date: May 1, 2014

(87) PCT Pub. No.: WO2013/064257

PCT Pub. Date: May 10, 2013

(65) Prior Publication Data

US 2014/0284227 A1 Sep. 25, 2014

(30) Foreign Application Priority Data

Nov. 3, 2011 (DE) ..... 20 2011 107 421 U
Aug. 8, 2012 (DE) ..... 20 2012 007 549 U

(51) Int. Cl.
*A45C 11/18* (2006.01)
*A45C 1/06* (2006.01)

(52) U.S. Cl.
CPC ..... *A45C 11/18* (2013.01); *A45C 11/182* (2013.01); *A45C 2001/062* (2013.01); *A45C 2001/065* (2013.01); *A45C 2001/067* (2013.01)

(58) Field of Classification Search
CPC ..... B65D 83/12; A45C 11/184; A45C 11/18; A45C 11/182; A45C 2001/062; A45C 2001/065; A45C 2001/067; A45C 2001/083; A45C 13/06; A45C 13/04; A45C 13/08; A45V 2200/05
USPC ..... D11/78.1
See application file for complete search history.

(56) References Cited

U.S. PATENT DOCUMENTS 1,194,360 A * 8/1916 Conley ..... 206/39.6
3,416,586 A * 12/1968 Voss ..... 150/137
D213,236 S * 1/1969 Zacharia ..... D19/86
4,056,139 A * 11/1977 Murt ..... 150/137
5,718,329 A 2/1998 Ippolito et al.
(Continued)

FOREIGN PATENT DOCUMENTS

WO WO-2005/058090 6/2005
WO WO-2007/10880 9/2007

*Primary Examiner* — Anthony Stashick
*Assistant Examiner* — James Way
(74) *Attorney, Agent, or Firm* — Norris McLaughlin & Marcus P.A.

(57) ABSTRACT

A holding device for cards and/or notes includes a housing, which includes at least one clip and a base. The holding device is so designed that production is simplified, wherein secure storage of individual or multiple cards and/or notes is made possible. To this end, the base of the housing, which is open at the top toward the at least one clip, includes upwardly projecting side ridges, which are disposed at a distance from each other and, if no cards or notes are disposed in the housing, each of the at least one clip is located partially between the side ridges and has a free end extending at least approximately to the bottom plane of the base.

21 Claims, 14 Drawing Sheets

(56) References Cited

U.S. PATENT DOCUMENTS

| | | | | |
|---|---|---|---|---|
| 5,938,010 | A * | 8/1999 | Osterbye | 206/38 |
| 6,173,837 | B1 * | 1/2001 | Marconi | 206/457 |
| 6,592,003 | B2 * | 7/2003 | Silverthorne | 221/60 |
| D505,355 | S * | 5/2005 | Elnekaveh | D11/78.1 |
| D525,162 | S * | 7/2006 | Suman | D11/78.1 |
| 7,331,366 | B1 | 2/2008 | Patterson | |
| 7,334,616 | B2 * | 2/2008 | Kaminski | 150/147 |
| 2005/0199710 | A1 * | 9/2005 | Richter | 235/380 |
| 2006/0076094 | A1 * | 4/2006 | Kaminski | 150/147 |
| 2008/0178976 | A1 * | 7/2008 | Lakhiani | 150/137 |
| 2010/0065171 | A1 | 3/2010 | Uzelac | |

* cited by examiner

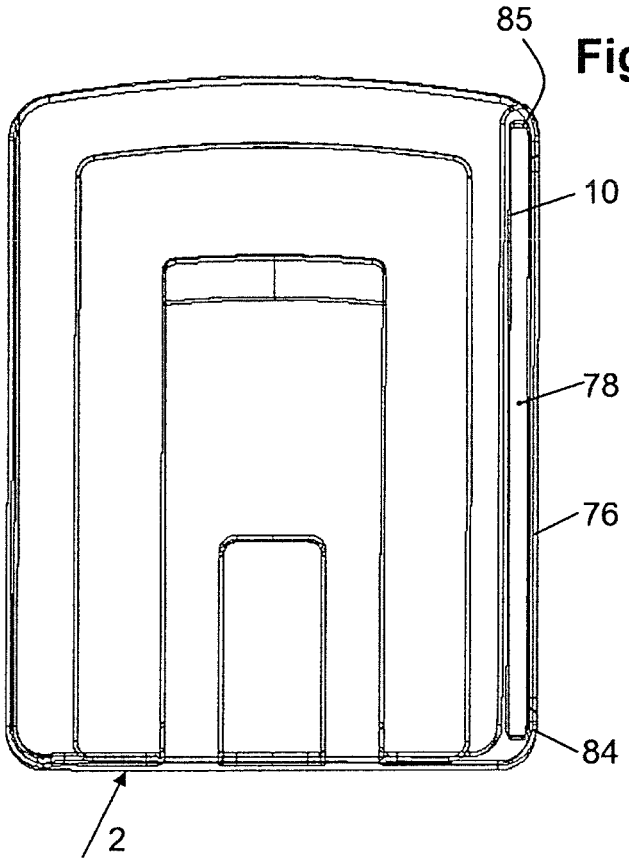
Fig. 15
Fig. 16
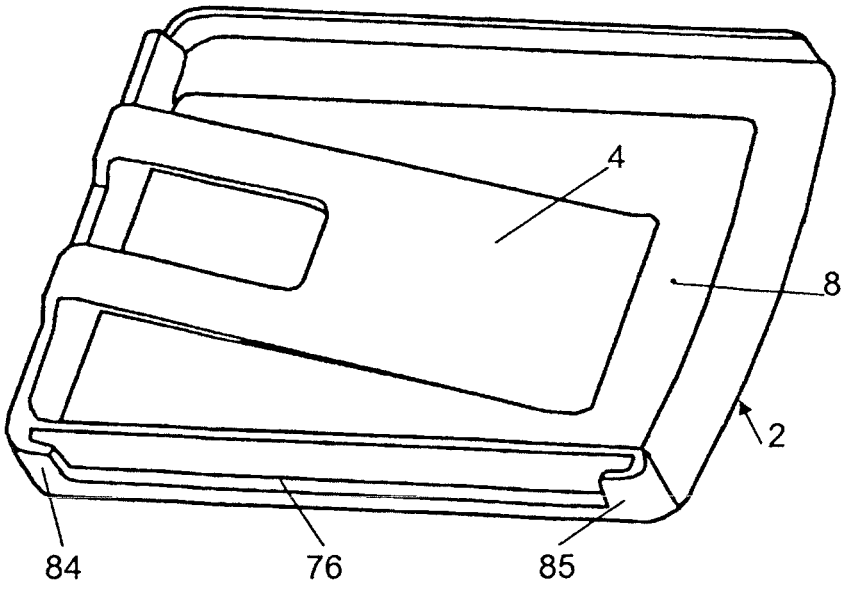

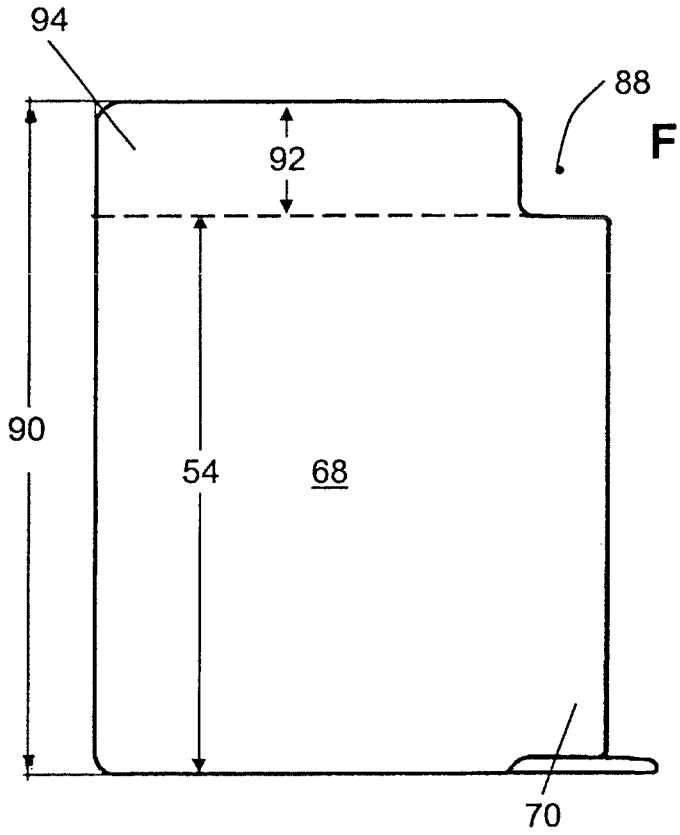
Fig. 17
Fig. 18
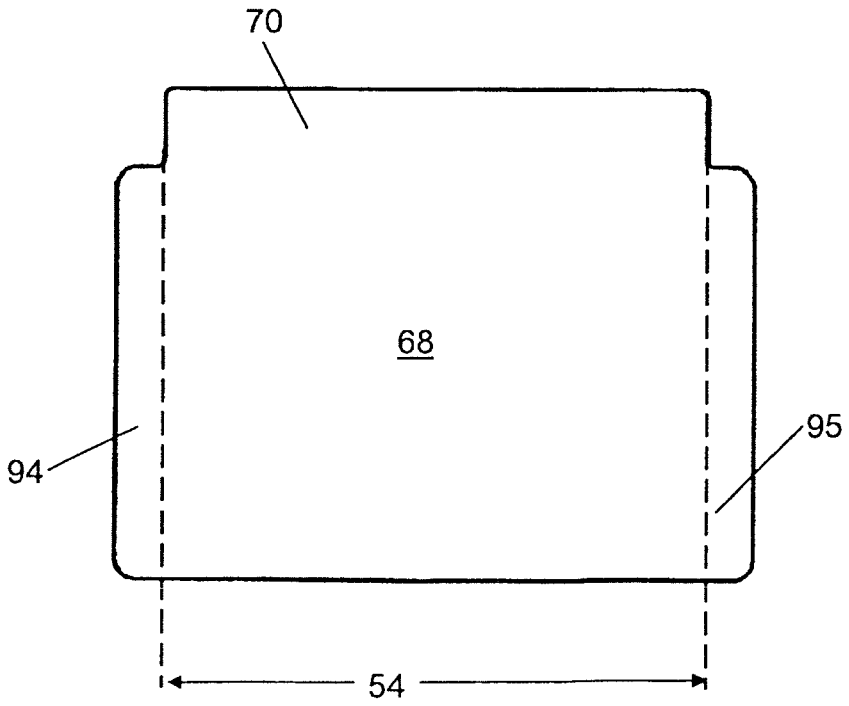

HOLDING DEVICE FOR CARDS AND/OR BANKNOTES

BACKGROUND OF THE INVENTION

The invention relates to a holding device for cards and/or notes according to the features described in the claim.

Such a holding device is known from WO 2007/108 800 A1, the housing of which is composed of a top part and a bottom part. The top part and the bottom part have a shell-shaped design comprising side walls, which include mutually corresponding grooves and panels as well as boreholes and pins for joining. A cavity for accommodating cards is present between the top part and the bottom part, and a slot-shaped opening is located on a front side, through which cards can be inserted into the interior space or removed therefrom. Moreover, a clip is fixed as a third component, in the region of a rear wall of the housing located opposite the opening, the free end of the clip being resiliently seated on the outside of the surface of the bottom part so that bank notes, for example, can be clamped between the clip and the top part. The bottom part comprises a retaining element for cards, which projects into the interior space. Producing the holding device composed of the aforementioned three components requires significant complexity, in particular with respect to three differently designed molding tools and additional measures for joining the top part, bottom part and clip.

SUMMARY OF THE INVENTION

Proceeding from this, it is the object of the invention to improve the holding device to the effect that production is simplified, while functionally appropriate storage of cards and/or notes is made possible and these can be removed from the holding device without difficulty. Moreover, the holding device should have a low material use and a low overall weight. In addition, the holding device should allow secure storage or secure clamping of both individual cards and/or notes, and of a large number of the same.

The holding device according to the invention is characterized by a simple design and allows functionally appropriate storage of cards and/or notes, wherein the insertion and removal of the same can be carried out without difficulty. The housing is designed in one piece, and the clip; one or more, is preferably an integral part of the same. The holding device is preferably designed as a case and is used to store cards, such as credit cards or debit cards, in particular in the customary so-called credit card format, as well as bank notes, documents, notes or the like. Both the notes and the cards are clamped in the housing by way of the clip or clips, no additional means for separately retaining the cards being necessary. The housing further comprises two mutually opposing side ridges, which project from the base, and between which the card or cards can be secured. If no cards or notes are located in the housing, the clip extends, or the clips extend, at least approximately to the base of the housing. The base preferably includes a cut-out through which the at least one spring-elastic clip passes, if no notes or cards are present in the holding device. The region above the base and the ridges is clear, and no top part is present, so that the clip extends at least to the base and/or to the cut-out in the base, and preferably is able to pass through the cut-out at least partially. When a card and/or a note is inserted, the spring-elastic clip is lifted and biased, so that thereafter even just a single card is held securely or clamped in the housing thereafter as a result of the bias. The dimension of the cut-out is predefined large enough for the card, or cards, to be easily moved using two fingers or thumbs so that the desired card is easily accessible and can be removed.

The cut-out moreover has a considerably larger width than the clip or clips, and more particularly such that a user can reach through on at least one side, or in the region of the tip of the clip, for example with a finger, so as to minimize the preloading force that is exerted by the clip, or clips, onto the cards, and thus be able to readily remove the desired card from the housing. The aforementioned side ridges advantageously have differing heights in such a way that notes or cards larger than predefined by the distance between the side ridges, such as business cards, can protrude beyond the shorter side ridge and are nonetheless tightly secured. In a specific embodiment of the invention, a cover is additionally provided, which is attached to one of the aforementioned side ridges, or to a connecting ridge of the same, and can optionally also be replaced, if needed. The housing further includes at least one indentation so as to facilitate the insertion or removal of cards and/or notes.

Refinements and specific embodiments of the holding device according to the invention are described in the following description of exemplary embodiments.

The invention will be described in greater detail hereafter based on specific exemplary embodiments shown in the drawings, without thereby limiting the invention in this respect.

BRIEF DESCRIPTION OF THE DRAWINGS

In the drawings:

FIGS. 12 to 16 are views of the housing for the specific embodiment comprising a cover;

FIGS. 17, 18 show exemplary embodiments of the cover;

DETAILED DESCRIPTION OF THE INVENTION

Figure 1:
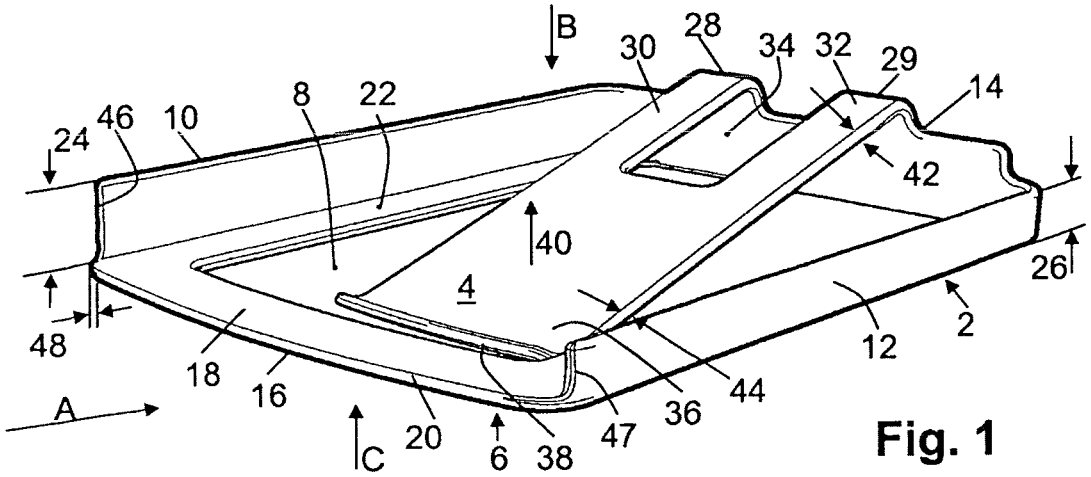
FIG. 1 shows a perspective view of the holding device.

The holding device shown in FIG. 1 comprises a housing 2 and a clip 4 that is connected, particularly integrally, thereto, and/or a single clip 4. The holding device and/or the case is preferably made of a spring-elastic plastic material, such as PES or PSU, and/or of plastic materials having high processing temperatures and/or of high-temperature-resistant plastic materials, which have a low tendency to creep when they are plastically deformed. The plastic materials that are used can advantageously be reinforced with fibers, and in particular carbon fibers. Other plastic materials may also be provided, such as POM, ABS, PA (filled with glass fibers or glass spheres), or the like. As an alternative, the holding device according to the invention can be made of sufficiently spring-elastic metal, such as stainless steel in particular, wherein both the spring elasticity of the clip and the overall stability are predefined, in particular by the predefined dimensioning of the thickness of the clip 4, and that of the housing. The housing 2 is designed in the manner of a frame and comprises a base 6, in which a cut-out 8 is advantageously provided, a first side ridge 10 and, located opposite thereto, a second side ridge 12, which are joined by way of a connecting ridge 14. However, no ridge is provided opposite the connecting ridge 14, so that at this end, which hereinafter is referred to as the front end 16, only a front base section 18 is present, across which cards can be inserted into the housing 2 between the mutually opposing side ridges 10, 12. In an alternative specific embodiment, the front base section 18 can also be dispensed with. The two side ridges 10, 12 are distant from each other by an amount that is substantially as large as, and advantageously slightly larger than, the width of conventional credit cards, debit cards or the like. The side ridges 10, 12 and the connecting ridge 14 extend substantially in a U shape and are disposed, at least approximately, orthogonally to the base 6.

A clearance is present above the base 6 and the side ridges 12, 14 so that the clip 4 can extend at least to the cut-out 8, and can preferably at least partially pass through the same. It shall be expressly noted here that, for the exemplary embodiments comprising two clips described below, the following comments made with respect to one clip apply analogously to the exemplary embodiments comprising two clips. While no cards or notes are present in the housing, the clip 4 passes through the cut-out 8.

The cut-out 8 takes up a considerable portion of the overall area of the base 6, and more particularly it is considerably larger than half the overall area of the base 6, which is predefined by the aforementioned ridges 10, 12, 14 and the outer or front edge 20 of the base section 18. The cut-out 8, which is also referred to as a window, is preferably predefined at a size and/or extent that a user can reach through with two thumbs next to each other and consecutively withdraw the cards from the stack or remove them from the holding device or the case. This advantageously facilitates the search for the "right card" since, in particular, the cards that are pushed to the side can nonetheless be moved around and easily inserted and/or returned into the holding device or the case again. Due to the predefined large design of the cut-out 8, while it is not possible to move the card using only one thumb or finger, the cards can be pushed or pressed and/or simultaneously pulled using two thumbs or fingers. This can be carried out until the desired card is visible, in particular at the top, and can be withdrawn from beneath on the ejection side and/or at the front end.

The front edge 20 is preferably rounded and/or curved, so that cards can be easily inserted. The lateral base section 22, from which the first side ridge 10 projects upward according to the drawing, expediently has a width that is advantageously smaller than the height 24 of the first side ridge 10. The lateral base section associated with the second side ridge 12 expediently has substantially the same width as the lateral base section 22. The height 26 of the second side ridge 12 is smaller than the height 24 by a predefined magnitude, as will be described in more detail hereafter. However, it is preferable that no base section is present in the area of the connecting ridge 14. As a result of this asymmetrical design of the side ridges 10, 12, cards having a larger width than is predefined by the distance between the side ridges may be advantageously stored in the housing.

The single clip 4 is expediently joined to the connecting ridge 14 by way of curved regions 28, 29, the clip 4 having two clip sections 30, 32 there, which are disposed at a distance from each other and between which a cut-out 34 is located. This optimizes the spring elasticity and/or flexibility of the clip 4. The connecting ridge 14 further serves as a limit stop for introduced cards. The clip 4 is substantially flat and has a free end 36 comprising a tip 38 that projects upward relative to the base. The clip 4 is designed and/or disposed and/or has a length relative to the connecting ridge 14 in such a way that the clip extends into the cut-out 8, penetrates the cut-out 8 over a considerable portion of the overall length, and protrudes beyond the bottom side of the base 6. As is further apparent, the clip 4 is inclined at a predefined angle relative to the base 6, if no cards or notes are inserted into the holding device. According to the invention, this predefines a bias. Even if only a single card is introduced into the housing 2, the clip 4 is lifted out of the cut-out 8 in the direction of the arrow 40 and will hold even this single card tightly in the housing 2 as a result of the predefined bias.

The bias is predefined by the spring elasticity of the clip, and particularly advantageously also via the connecting ridge 14, applying torsional forces via the clip onto the card, or cards, and notes, in particular since no base section is present in the region of the connecting ridge 14. The pressure or the force of the clip 4 builds not only via the flexibility of the two clip sections 30, 32, but also due to torsion of the connecting ridge 14. Moreover, the two clip sections 30, 32 play a role in the optimized flexibility, and thus in the application of the preloading force and/or the clamping force in the opposite direction of arrow 40. Moreover, the thickness 42 of the clip 4 and/or of the clip sections 30, 32 in the connecting region with the connecting ridge 14 is greater than the thickness 44 at the free end 36. The clip 4 thus has decreasing thicknesses toward the tip 38. As a result, at the front of the region of the tip 38 of the clip 4, the force is advantageously introduced at a favorable point so as to fix cards or notes that are inserted into the housing 2 in a favorable region. Owing to the decreasing wall thicknesses of the clip 4 toward the tip, the point of support of the clip 4 shifts considerably more easily in the direction of a smaller lever and/or based on the curved region or regions 28, 29, which may in particular be curved, and/or the region connecting the clip 4 to the connecting ridge 14 and/or the housing, depending on the height of the stacked card level. The front edges 46, 47 of the side ridges 10, 12 are disposed at a distance 48, and recessed, from the front edge 20 in the direction of the connecting ridge 14. Moreover, the front edges 46, 47 are rounded, so that the insertion of cards into the housing 2 counter to the clip 4 can be carried out particularly easily and readily beneath the, likewise rounded, tip 38 of the clip 4.

Figure 2:
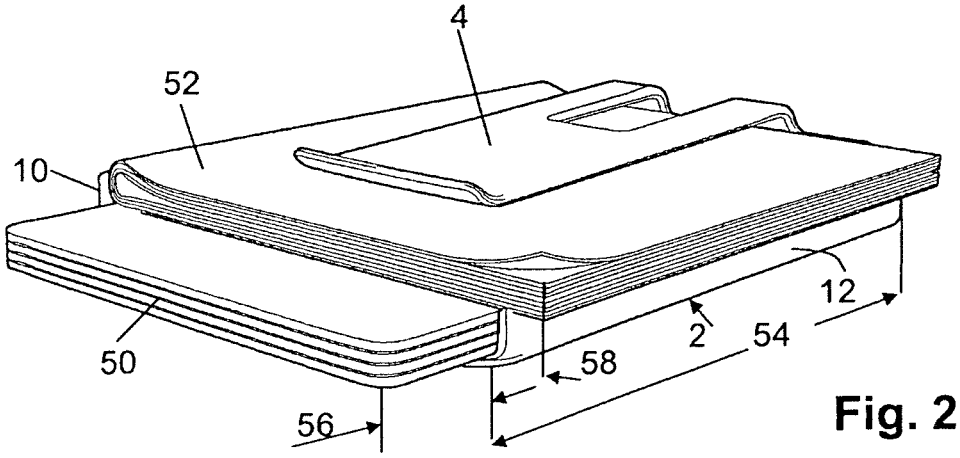
FIG. 2 shows a view of the holding device according to FIG. 1, having cards and notes stored therein.

FIG. 2 shows the holding device together with cards 50 and bank notes 52, which are inserted into the housing 2 and jointly clamped by way of the clip 4. The length 54 of the housing 2 is predefined so that the cards 50 protrude from the housing 2 with a predefined overhang 56 and are thus easy to grasp and remove when needed. Due to the differing height of the two ridges 10, 12, the bank notes 52, or documents, or the like, can further rest on the upper edge of the lower second connecting ridge 12 and can likewise protrude laterally from the housing 2 with an overhang 58. The higher side ridge 10 is preferably designed so that ten cards can basically be carried without difficulty, without the cards 50 being pushed over the lower side ridge 10. The lower ridge 12 is advantageously designed so that cards, bank notes, or documents, or the like, can protrude laterally without creating a bulky appearance, if few of these are deposited. Secure storage of the notes 52, or documents, or the like, and/or of the cards 50 is achieved by the asymmetrical design of the side ridges 10, 12, and consequently of the housing 2. To remove one or more cards 50 of the illustrated stack, a user can push a finger, and preferably two fingers or both thumbs, from the bottom side of the housing 2 through the cut-out 8 of the base 6 in the direction of the clip 4, whereby the retaining force applied by the clip 4 is minimized and the desired card 50 can be easily pushed out. For this purpose, a user holds the housing 2 in his hand using the thumb and little finger, for example, and pushes the card, or cards, according to FIG. 2 slightly up through the cut-out using the middle finger. It goes without saying that a user can push out not only the card at the bottom or at the top of a card stack, but can also withdraw a center card, for example, wherein he first slightly removes one or more adjacent cards in the center so as to then completely push out the desired card. It shall also be noted that, as the bank notes or the like have sufficient flexibility, even just a single card is held securely together with bank notes in the holding device due to the bias of the clip 4, which is predefined according to the invention.

Figure 3:
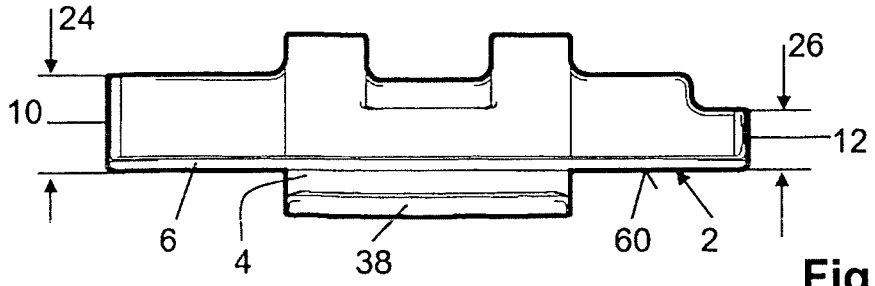
FIGS. 3, 4 are views in the viewing direction A according to FIGS. 1, 2.
Figure 4:
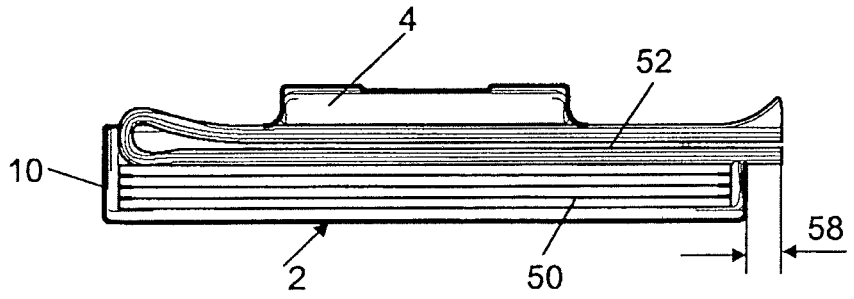

FIG. 3 and FIG. 4 show the holding device in the viewing direction A according to FIG. 1, with and without cards 50 and notes 52. According to the invention, the housing 2 is asymmetrical insomuch as the first side ridge 10 has the height 24, which is greater than the height 26 of the second side ridge 12, so that according to FIG. 4 the notes 52 protrude over the second side ridge 12 with the overhang 58. Due to the described cut-out in the base 6, according to FIG. 3, the clip 4 passes at least partially through the cut-out and protrudes with the tip 38 beyond the bottom side 60. According to FIG. 4, the notes 52 are partially seated against the higher first side ridge 10 and, on the other side, rest on the upper edge of the shorter second side ridge 12 so as to laterally protrude from the housing 2 with the overhang 58.

Due to the asymmetrical design of the side walls or side ridges 10, 12, cards, and more particularly business cards, can protrude, since business cards are frequently wider than credit cards by a predefined amount of 1 mm or a few mm. Moreover, it is particularly advantageous that the opposing corner of the overhang and/or an inside corner has a very small radius, in particular since the design without a radius and/or a radius is basically impossible from a manufacturing perspective. The corner and/or the overhang is required to be able to accommodate wider cards, such as business cards, whereby a tight tolerance can advantageously be selected for credit cards to prevent these from falling out too easily. In particular, business cards do not end up with dog ears, and the tolerance in terms of the width of the holding device or of the case can be dimensioned smaller since business cards, which are larger than credit cards, are able to protrude. Moreover, it shall be pointed out in particular that, according to the invention, cards can preferably be inserted into the holding device or the case not only from one side, but from three sides, if needed.

Figure 5:
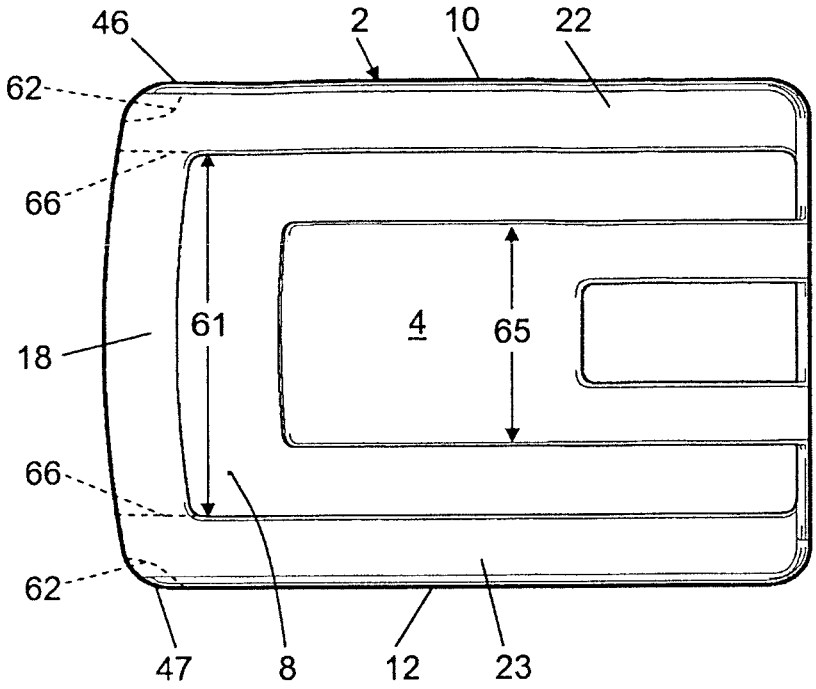
FIGS. 5, 6 are top views onto the holding device in the viewing direction B according to FIGS. 1, 2.
Figure 6:
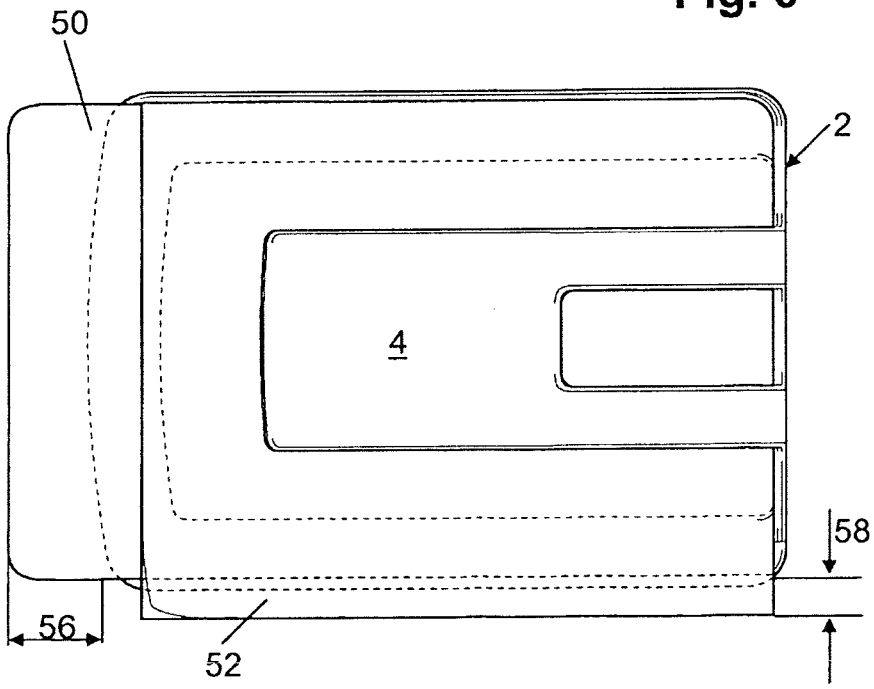

FIGS. 5 and 6 show views of the holding device in the viewing direction B according to FIG. 1, wherein the relatively large cut-out 8, into which the clip 4 partially projects, is easily apparent in FIG. 5. In FIG. 6, the cards 50 and the overhang 56 thereof are easily apparent, as is the overhang 58 of the notes 52, which are clamped into the housing 2 by way of the clip 4. The cut-out 8 has a width 61 that is considerably larger than the width 65 of the clip 4, and more particularly such that free gaps are present between the side of the clip 4 and the lateral base sections 22, 23. As is further apparent from the drawing, a free gap is also present between the base section 18 and the front end of the clip 4. The aforementioned gaps are predefined in such a way that a user can reach through with a finger. If cards are present in the housing 2, a user can reach through one of the aforementioned gaps with a finger and push on the uppermost card of the card stack so as to minimize the retaining force or biasing of the clip 4, so that the desired card can be pushed out of the housing 2 more easily. The user can thus not only withdraw the uppermost card, but can also remove the third card of the stack, for example, wherein the two top cards are preferably pushed out up to the middle and then the third card can be readily pushed out.

According to the invention, the holding device is designed as a frame, which comprises the two narrow lateral base sections 22, 23 and preferably the front base section 18, and the two side ridges 10, 12, which are joined to each other via the rear connecting ridge 14. The preferably rectangular cut-out 8 has a width 61 that is considerably larger than the width of the base sections 22, 23. The cut-out 8 advantageously ends at the rear connecting ridge 14, so that no base section is present there and/or the frame-shaped housing 2 is held together by way of the rear connecting ridge 14. The rear connecting ridge 14 connects the two side sections 10, 12, which are joined, preferably orthogonally, to the lateral base sections 22, 23. Relative to the base 6, the housing 2 designed as a frame is open at the top toward the flexible clip 4, wherein the clip 4 extends from the top to the base, or to the cut-out 8 thereof, or passes through the same.

An alternative embodiment is shown with dotted lines in FIG. 5, according to which undercuts 62 are provided in the region of the front edges 46, 47 of the side ridges 10, 12, the undercuts forming detent elements for the purpose of fixing the cards. The undercuts 62 or card detents are designed so that cards can be pushed through between opposing detents 62. Moreover, additionally or alternatively, the front base section 18 can be dispensed with, as is indicated by dotted lines 66. Owing to the flexibility of the housing 2, and in particular of the side ridges 10, 12 thereof, having the card detents designed as undercuts 62, the cards can be easily pushed into the housing 2 and removed therefrom.

Figure 7:
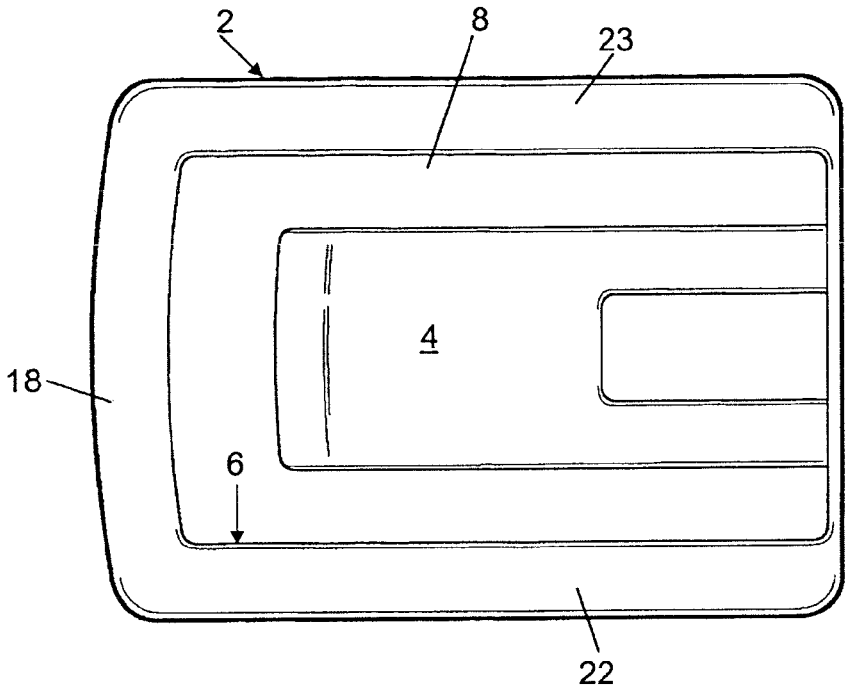
FIGS. 7, 8 are views of the holding device in the viewing direction C according to FIGS. 1, 2.
Figure 8:
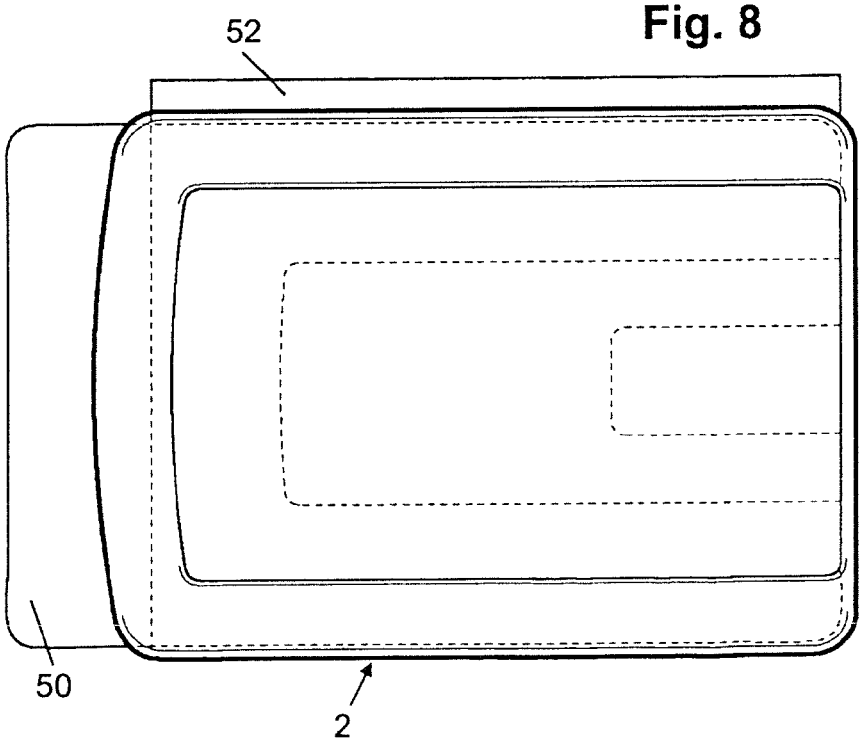

FIGS. 7 and 8 show the holding device comprising the housing 2, the clip 4 and the cut-out 8, wherein FIG. 7 shows the base section 23, which is associated with the side ridge 12, and wherein according to FIG. 8 the inserted cards 50 and the notes 52 are again apparent. The holding device according to the invention fulfills the practical requirements and/or objectives with regard to ease of handling for storing cards and/or notes, with low design complexity, whereby functionally secure accommodation and easy removal of the same are achieved. Moreover, the holding device advantageously has a low weight and/or low material use. The asymmetrical design of the housing 2 and/or the design of the aforementioned side ridges 10, 12 having differing heights are particularly important, so as to securely retain both cards and bank notes or the like by way of the clip 4 and be able to easily remove them from the holding device as needed.

Figure 9:
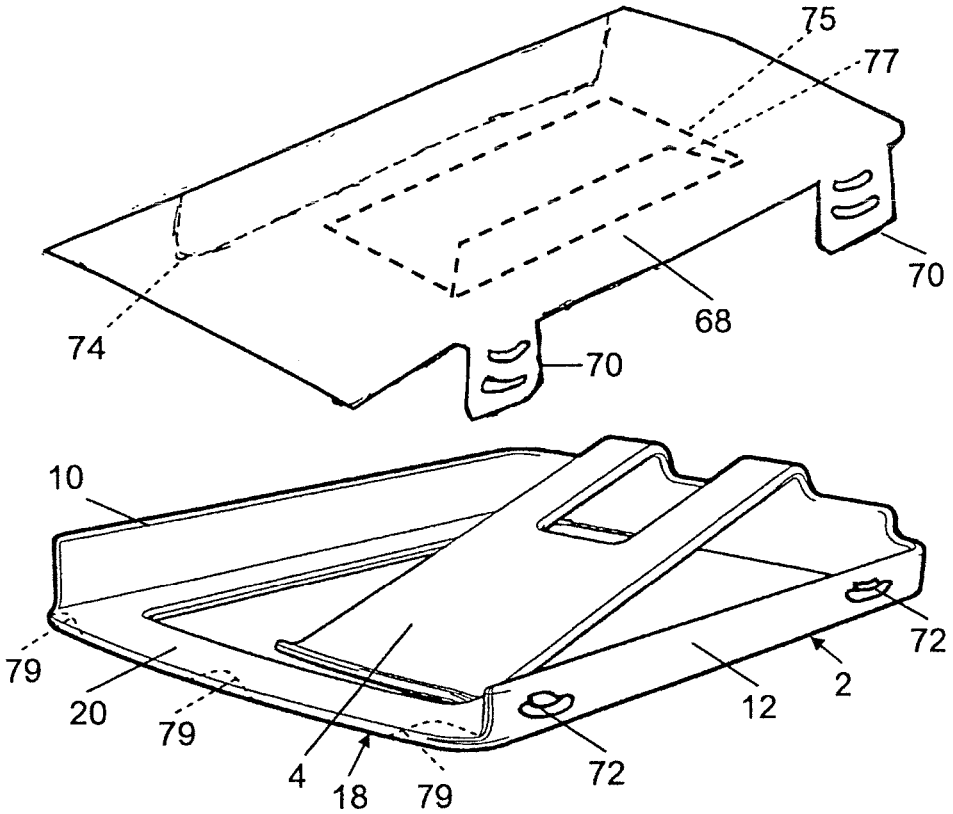
FIGS. 9 to 11 are perspective views of a specific embodiment comprising a cover.
Figure 10:
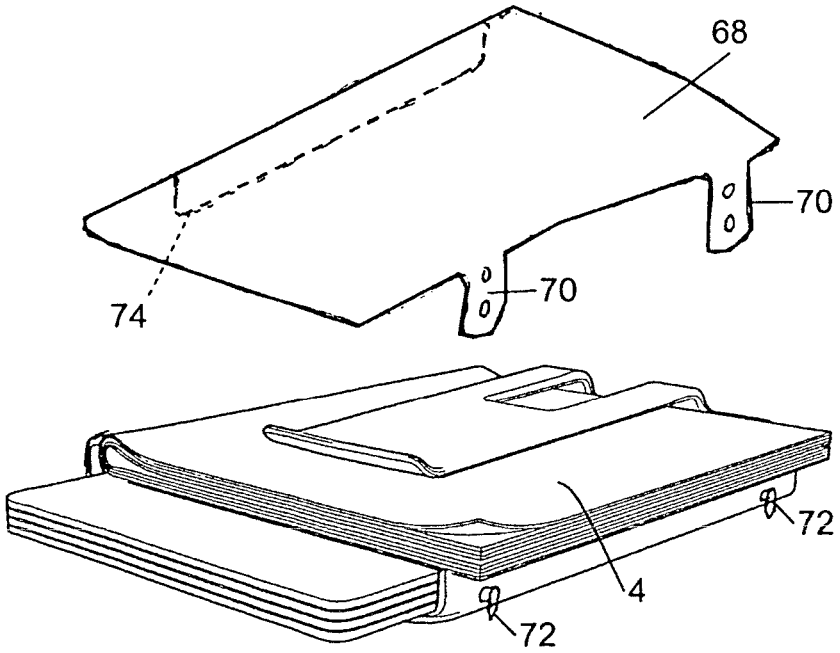
Figure 11:
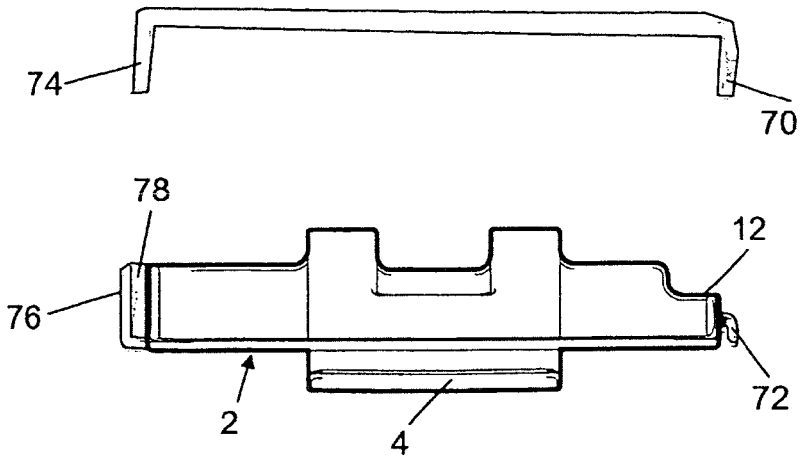

FIGS. 9 to 11 show specific embodiments of the invention, according to which the holding device and/or the case comprises a cover 68. The cover 68 is located at the top above the at least one clip 4 and any optionally inserted cards and/or notes when closed. The flexible cover 68 comprises at least one connecting body 70 and, corresponding thereto, the housing 2 comprises at least one connecting element 72, in particular on the second side ridge 12. According to FIG. 9 and FIG. 10, two connecting bodies 70 and two connecting elements 72 are present. As is apparent, the clip 4 is covered by the cover 68 after the connection between the cover 68 and the housing 2 has been established. The cover 68 is made at least partially of a flexible material, such as soft leather, felt, fur or plastic material, and can be pivoted away from the housing or the clip 4 as needed, so that the notes and/or cards are made easily accessible for the user. As an alternative, the cover 68 can be made of a substantially non-deformable material, such as metal or hard plastic material, within the scope of the invention, wherein the connecting body is, or the connecting bodies 70 are, designed as hinges, and/or hinges, and in particular integral hinges, are present between the connecting body, or the connecting bodies 70, and the cover. Opposite the connecting body or connecting bodies 70, the cover 68 comprises a tab 74 and, corresponding thereto, the housing 2 comprises a further ridge 76 on the first side ridge 2, and more particularly disposed at a distance therefrom, leaving a clearance 78. The tab 74 can engage in the clearance 78.

In one expedient refinement, as shown by the dotted lines in FIG. 9, the cover 68 can include a pocket 75 for loose change or coins or other small items on the bottom side or the top side. A flap 77 or another closure, such as a snap fastener or zipper, can preferably be provided.

According to a further embodiment, the housing can comprise at least one indentation 79, shown in dotted form, as an insertion aid on the insertion side and/or in the base 6 and/or in the base section 18, whereby easy insertion or removal of the card or cards is made possible. As is shown, the at least one insertion aid or indentation 79 can be provided in the corners and/or at the center, but other positions of the indentation in question are, of course, also covered by the scope of the invention.

In an alternative embodiment according to FIG. 11, the cover 68 can be inserted into the clearance 78 by way of the tab 74 and secured there with respect to the housing 2, for example inserted and/or clamped and/or glued. In such an embodiment, the connecting bodies 70 or the connecting elements 72 are not provided for the purposes of permanent connection, but only to secure the cover when it is closed. When a user wants to withdraw cards or notes from the holding devices or the case, he can detach the connecting body, or connecting bodies 70, from the connecting element, or connecting elements 72, and pivot the cover 68 away, and the connection of the tab 74 in the clearance 78 will be preserved. In another specific embodiment, the tab and/or the cover 68 can be connected to the housing 2 in the manner of a clamping strip by way of a further ridge 76, and more particularly such that the cover can be easily connected to the housing and replaced and/or exchanged with another cover if needed.

Figure 12:
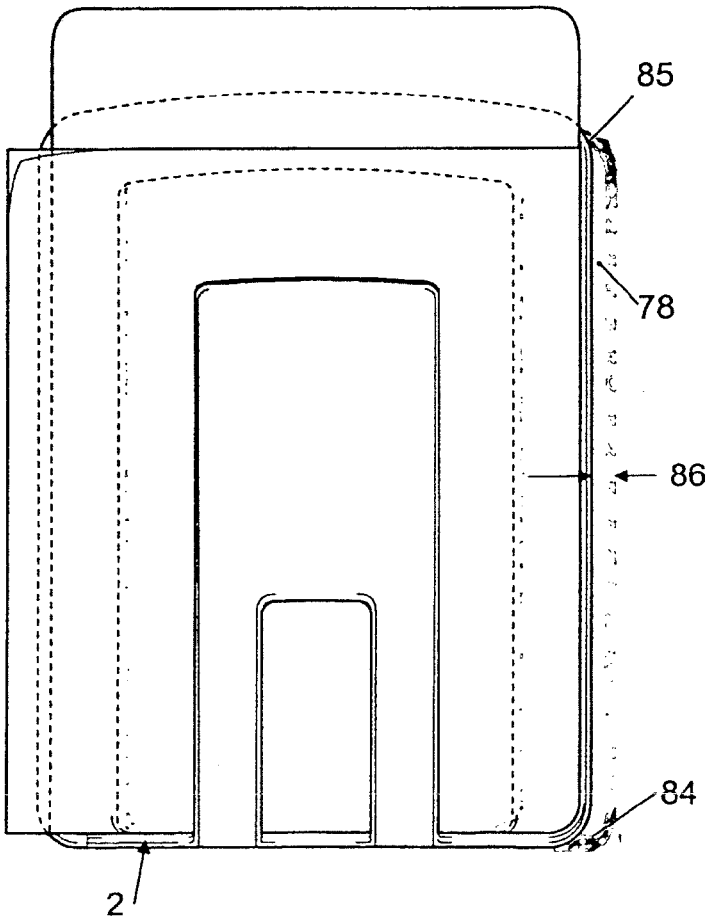
Figure 13:
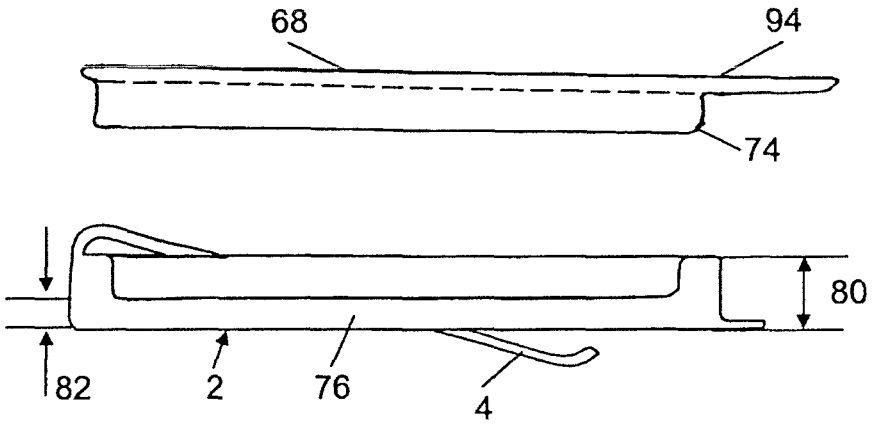

FIGS. 12 and 13 show an exemplary embodiment in which the housing 2 includes the above-mentioned further ridge 76 for accommodating the tab and/or the side section 74 of the flexible cover 68. As is indicated by crossed lines in FIG. 12 (description doesn't seem to correspond to FIG. 12), the further ridge 76 does not extend over the entire height 80 of the housing 2, but over a predefined fraction 82. The fraction 82 ranges between ¼ and ½ the total height 80 and has a value of at least approximately ⅜. As is indicated by thick lines in FIG. 12, however, the further ridge 76 extends essentially over the entire height 80 of the housing 2 in the preferably rounded corner regions 84, 85. The ridge 10 and the further ridge 76 thus form a double wall having a distance 86 corresponding to the width of the groove 78. The cover 68 further has an overhang 94, which in particular allows the cover to be grasped particularly easily for actuation.

Figure 14:
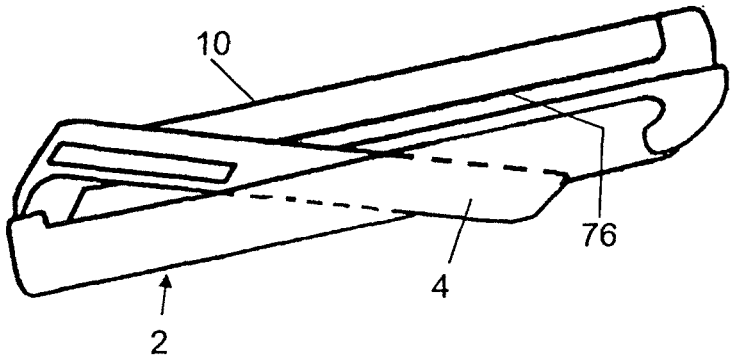

FIGS. 14 to 16 show an exemplary embodiment corresponding to FIGS. 12 and 13, wherein the insertion mechanism and/or the further ridge 76, together with the clearance 78 for accommodating the connecting section of the cover made of flexible and/or bendable material, in particular leather or plastic material, are provided on the longer lateral delimitation and/or on the side ridge 10. As is apparent, the cover is expediently attached to the side of the housing 2, so as to cover the "cash side." In this way, an embodiment is created which is easy and/or simple and/or inexpensive to produce and which allows a large number of cards and/or optional notes, such as cash, to be carried in the case according to the invention. As an alternative, the insertion mechanism can further be disposed on the connecting ridge 14 or associated therewith.

FIG. 17 shows the cover 68 having the lateral indentation 88 and the connecting section and/or the connecting body 70 so as to better attach the cover 68. The connecting section or the connecting body 70 is introduced into the aforementioned clearance and, in particular, is attached by way of adhesive. As a result of the lateral indentation, the cover can be easily attached to and/or connected to the housing in a functionally reliable manner. The indentation 88 may only frame the edge or surround the same according to or with the material thickness, so as to prevent dog ears from tilting up. The indentation is advantageously designed as a pocket, so as to frame the edge and/or the connecting body 70 of the cover in such a way that the edges are overlapped. It shall be noted here that the flexible cover 68 can preferably be made of leather, felt, neoprene, nonwoven fabric, rubber, cellular rubber, silicone or any arbitrary comparable materials, this is framed, in particular by way of the aforementioned indentation 88 as a pocket, in such a way that the edges are overlapped. Thus, particularly advantageously, the side flank or the connecting part 70, which is attached in the housing, and in particular in the clearance therein, is reliably surrounded by material, in particular plastic material of the housing, when changes occur to the material, for example when leather changes dimensions and warps next to the glued spot or other connecting means, and thus a clean and/or neat appearance and/or a functionally reliable connection exists. Simple and easy mounting of the cover 68 is achieved as a result of the recess of the indentation 88 and/or pocket and/or the aforementioned clearance.

Moreover, when the cover 68 and/or the connecting part are inserted into the aforementioned groove, it is possible to predefine a distance from an inside wall of the groove, so that the adhesive may, in particular, be applied more readily and/or easily. The cover 68 has a length 90 that is greater, by a predefined magnitude, than the length 54 of the housing described based on FIG. 2. The cover 68 thus has an overhang 94, which allows the cover to be easily grasped so as to pivot the same away. The length 92 of the overhang 94 is preferably at least equally as large as, and advantageously greater by a predefined value than, the overhang 56 of the edges described based on FIG. 2. The indicated dimensions are provided only by way of example and can be predefined differently within the scope of the invention, in particular as a function of the dimensions of the housing.

FIG. 18 shows a specific embodiment of the cover 68, which comprises a further overhang 95, in addition or as an alternative to the overhang 94 at the other end, wherein the connecting body 70 is present on one of the longitudinal sides. In an alternative embodiment, the connecting body 70' may be provided in place of the overhang 95, so that the cover 68 can be moved in the longitudinal direction of the housing and flipped up or moved back from the housing, or the cards and/or notes stored therein.

Figure 19:
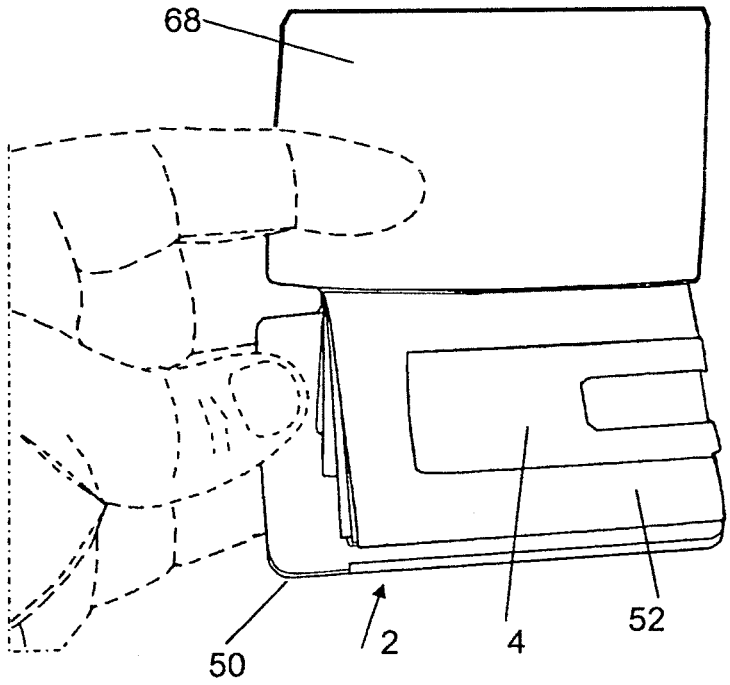
FIG. 19 shows the holding device or the case, wherein the cover is shown in the lifted or pivoted-up position.

FIG. 19 shows the housing 2 having cards 50 and notes 52 inserted therein, wherein the cover 68 is flipped up and pivoted away from these. When the cover 68 is pivoted back, the clip 4 and the notes 52 and cards 50 are covered.

Figure 20:
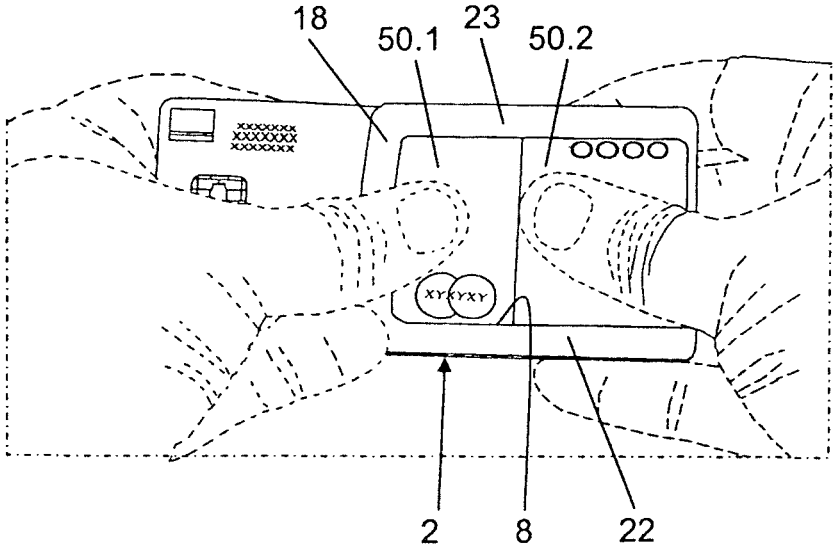
FIG. 20 shows a view from beneath onto the holding device including a stack of cards.

FIG. 20 shows the housing 2 in the viewing direction of the backs of the base comprising the narrow base sections 18, 22, 23 and the large cut-out 8. As a result of the size of the cut-out 8 being predefined according to the invention, a user can move or slide, or press and/or simultaneously pull, the cards 50.1 and 50.2 using not only one thumb, but both thumbs. The user can carry this out until he sees the desired card in the stack, which he can then pull out and/or withdraw completely from the housing of the holding device.

Figure 21:
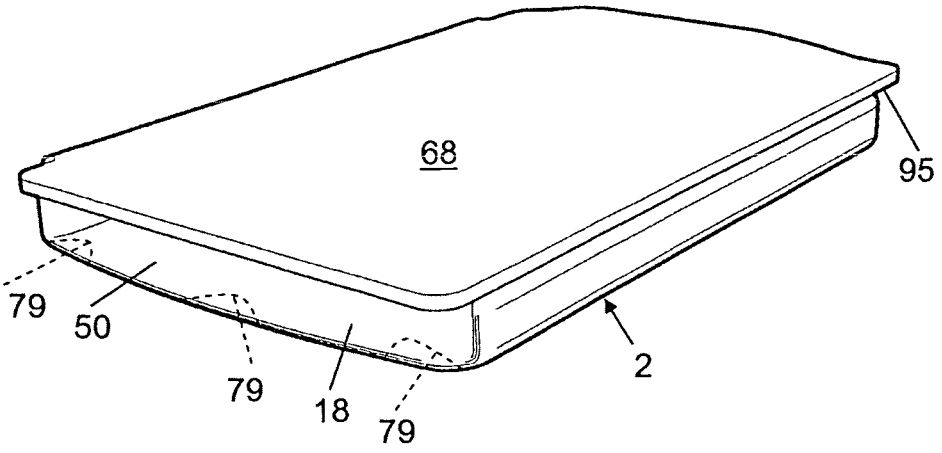
FIGS. 21 to 25 show views of one exemplary embodiment comprising a cover, which is shown in the closed position.
Figure 22:
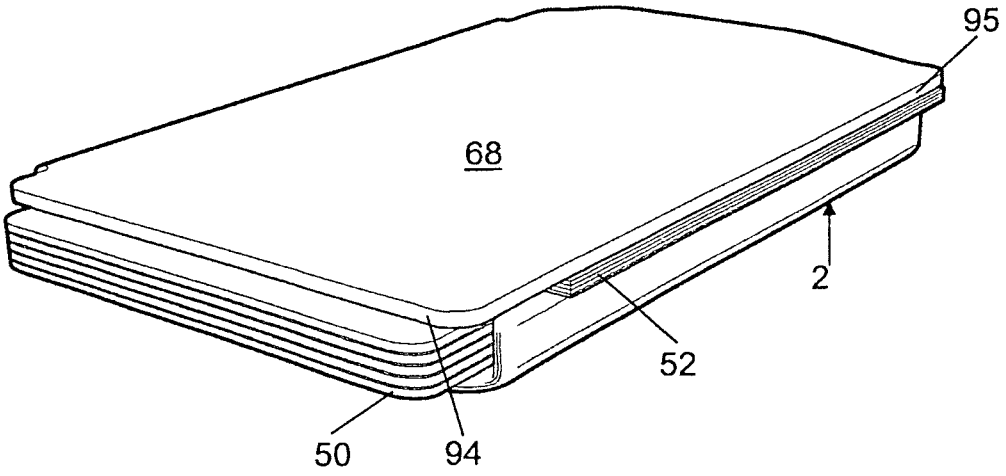

FIG. 21 shows the empty holding device or the case, while FIG. 22 shows cards 50 and notes 52 being inserted into the housing 2. The cover 68 is shown in each case in the closed position of the case, wherein the overhangs 94 and 95 can be easily seen. The clip 4 for retaining the cards 50 and notes 52 in the housing 2 is located directly beneath the cover 68. As was already described, the housing 2 has at least one indentation as an insertion aid in the base and/or base section 18 on the insertion side.

Figure 23:
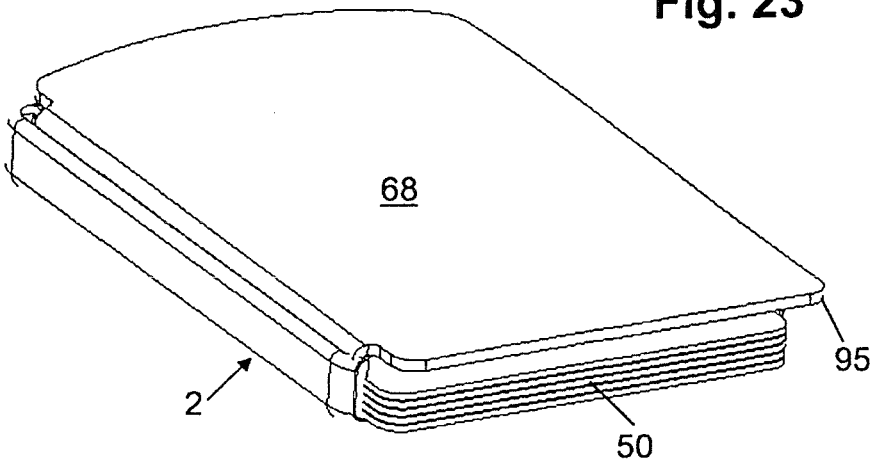
Figure 24:
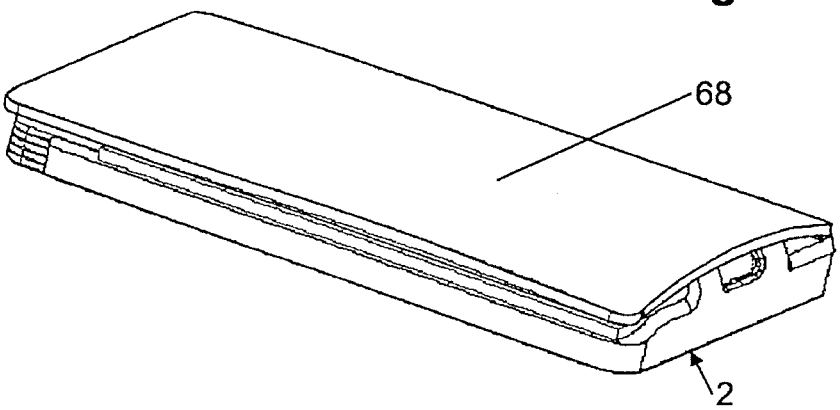
Figure 25:
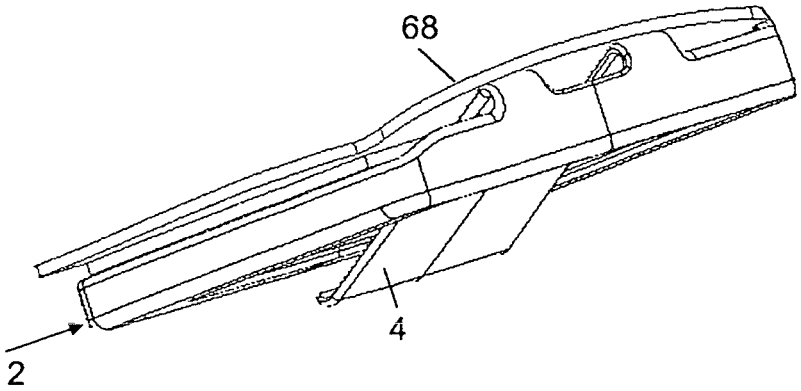

FIGS. 23 to 25 show perspective views of the holding device or of the case, having cards 50 inserted into the housing 2 and the cover 68 closed.

Figure 26:
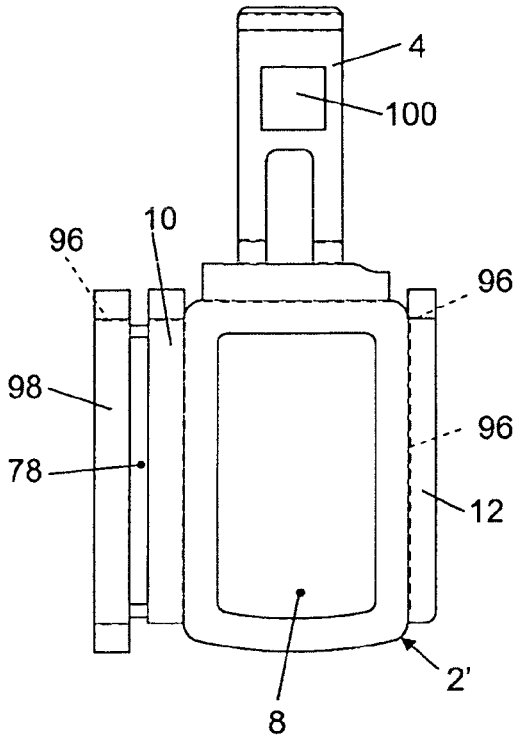
FIG. 26 shows a blank for producing the housing made of metal.

FIG. 26 shows the blank prior to bending the various components of the housing 2' for a specific embodiment of the housing made of metal. Dotted lines indicate the bending zones of the various components, such as the clip 4, the side ridges or side walls 10, 12, and the connecting ridge or the connecting wall 14. The cut-out 8 in the base 6 is also easily apparent. The side ridges 10, 12 preferably include end sections 96, which allow the connection after upward bending corresponding to FIG. 1. On the side ridge 10, there is an additional ridge section 98, which can be bent over so that the groove or the clearance 78', described above based on FIG. 12 or 15, for the connecting body of the cover 68 is formed. In a preferred alternative embodiment, the connecting body of the cover can be introduced, or preferably clamped, in particular by bending of the ridge section 98.

In a specific refinement, the clip 4 has a depression 100 on the bottom side, wherein the aforementioned bottom side having the depression 100 faces the notes or cards, or is seated thereon, after the clip 4 has been bent. A lining, in particular made of felt or another material that is softer than metal, can be provided in the depression 100 to protect the notes or cards. Moreover, additionally or alternatively, paint, which expediently is flocked with soft flock, may be provided on the bottom side and/or in the depression 100, so that the cards or notes are not damaged.

Figure 27:
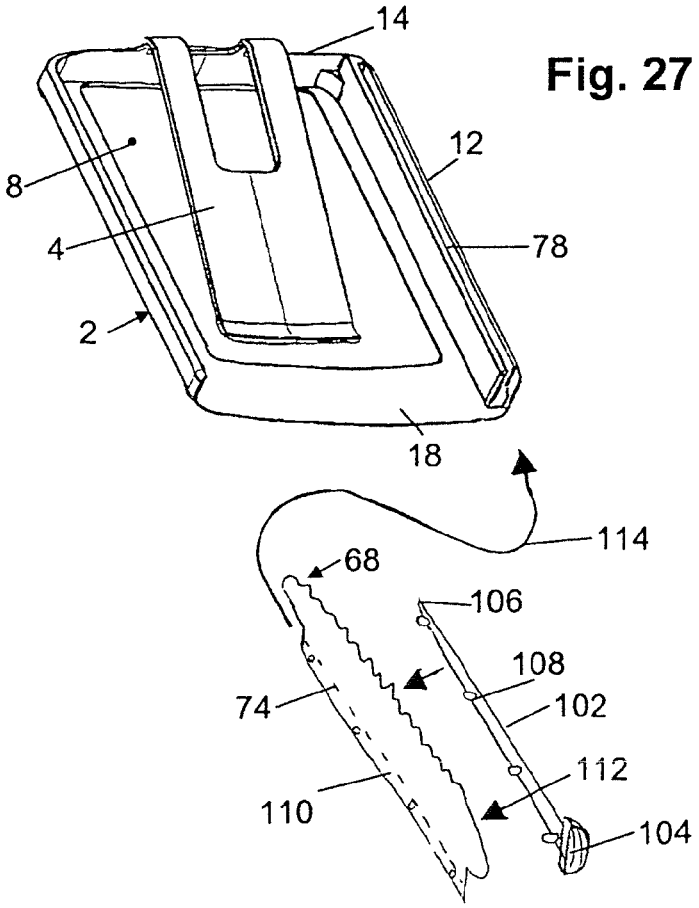
FIG. 27 shows one exemplary embodiment comprising an exchangeable cover.

FIG. 27 shows a specific embodiment of the connection of the partially illustrated flexible cover 68 to the tab 74. The second side ridge 12 includes the undercut groove 78, into which the cover 68, together with the tab 74, can be inserted by way of an insertion body 102. The insertion body 102 is preferably designed as a wedge so that, advantageously, the tolerance range between exchangeable covers, which are preferably made of leather, can be predefined in a larger size without difficulty. Proceeding from an expediently provided handle or covering body 104, the insertion body 102 has a conically tapering design toward the tip 106 and includes substantially radially projecting pins 108. The cover 68 or the side section 74 thereof includes holes 110 associated with the aforementioned pins 108. As is shown by the arrows 112, the insertion body 102 can be joined to the cover by way of the pins and the boreholes 110 and can be pushed into the undercut groove 78 in accordance with arrow 114 for connection to the housing 2. As an alternative, the insertion body 102 may be slotted, and the tab 74 may be clamped into the slot. In addition and/or as an alternative, the groove 78 can further be designed to taper and/or to narrow from the front base section 18 in the direction of the rear connecting ridge 14, so as to be able to easily carry out the insertion of the insertion body 2, wherein maximum clamping is achieved at the back, and/or when the insertion body 2 is basically completely inserted into the groove 78. The front opening of the groove is advantageously covered by way of the handle or covering body 114, the outer contour of which conforms to the contour of the side ridge 12. The insertion body 102 and the undercut groove 78 moreover comprise preferably mutually corresponding and/or engageable detent elements in such a way that functionally reliable fixation is ensured after the cover 78, or the side section 74 thereof, has been fully inserted.

Figure 28:
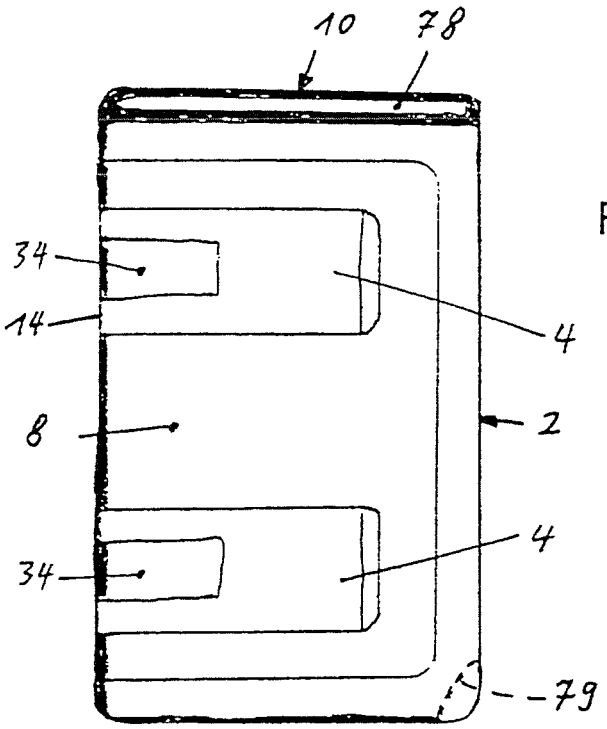
FIGS. 28, 29 show two exemplary embodiments comprising two clips.
Figure 29:
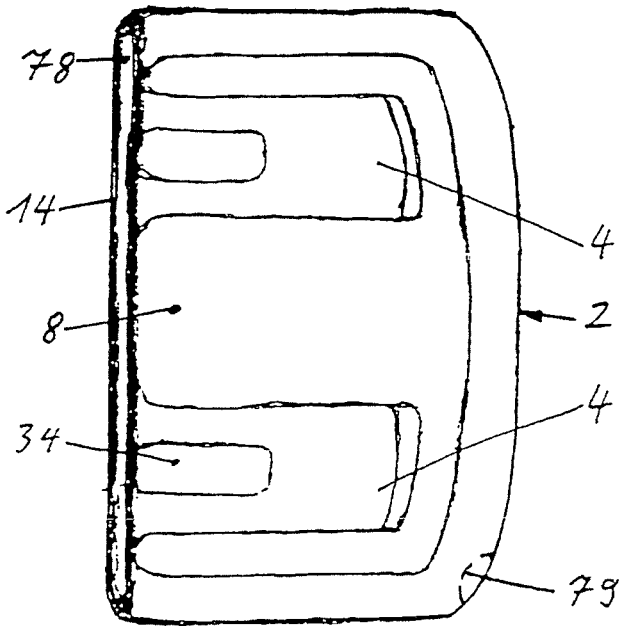

FIG. 28 and FIG. 29 show two specific exemplary embodiments of the holding device according to the invention, each comprising two clips 4, which are disposed on the connecting ridge 14 of the housing, the ridge being longer than in the exemplary embodiments described so far but the arrangement agreeing in all other respects. The housing 2 comprises the base having the cut-out 8, however this may also be dispensed with within the scope of the invention. In the exemplary embodiment shown in FIG. 28, the comparatively short side ridge 10 includes the groove 78 for securing the cover, which is not shown here. The base of the housing 2 has indentations 79 in the insertion region so as to facilitate the insertion or removal of cards. The groove 78 for securing a cover to the connecting ridge 14 is provided in the exemplary embodiment according to FIG. 29. Within the scope of the invention, the connecting bodies or connecting elements described based on FIGS. 9 to 11 can be provided in the exemplary embodiments of FIGS. 28 and 29 for securing and/or connecting a cover. It shall further be pointed out that the cover is advantageously designed analogously to the remaining exemplary embodiments that are described, so that inserted notes and/or cards are covered by the overhangs of the cover described in particular based on FIGS. 17 and 18.

The exemplary embodiments described based on the drawings include features that are shown and disclosed in the above description as well as in the drawings. It shall be expressly noted that, according to the invention, each individual feature that is described and/or apparent from the drawing can be provided and/or combined in a useful manner and/or for the particular requirement either alone, or in combination with one of the other individual features. Each feature combination of the described and/or illustrated individual features, which is suitable for achieving the underlying object, forms the subject matter of the present invention.

The invention claimed is:

1. A holding device for cards and/or notes, comprising a housing, the housing including at least one clip and a base, wherein the base has an open top plane, a bottom plane having a cut-out area, a first side ridge and a second side ridge projecting upwardly from the bottom plane of the housing, and a connecting ridge at one end of the bottom plane projecting upwardly from the bottom plane;

wherein the first side ridge and the second side ridge are disposed at a distance from each other, and the first side ridge projects upwardly from the bottom plane to a first height higher than the second side ridge;

wherein the at least one clip extends through the open top plane and between the first and second side ridges and, when the holding device has no cards or notes disposed in the housing, a free end of the at least one clip is received in the cut-out area;

wherein the first height of the first side ridge and a height of the connecting ridge are adapted so that the first side ridge and connecting ridge provide a bound to said cards and/or notes held between the bottom plane and the at least one clip when said holding device is holding said cards and/or notes;

wherein the second side ridge has a height adapted so that for a first note of a width exceeding a distance between the first side ridge and second side ridge, the first note is bound by said first side ridge and said connecting ridge while extending over the second side ridge beyond confines of the holding device, when the holding device is holding said first note.

2. The holding device according to claim 1, wherein the at least one clamp is springy and resilient that when at least one card or one note is disposed in the housing, the at least one clip is lifted and has a bias, which clamps the at least one card and/or the at least one note to the base.

3. The holding device according to claim 1, wherein the side ridges and the connecting ridge together form substantially a U shape, and a front end of the housing, opposite the connecting ridge has no upwardly projecting ridge so that cards can be inserted into the housing or removed therefrom at the front end.

4. The holding device according to claim 3, wherein each of the at least one clip is joined to at least one of the first side ridge, second side ridge and connecting ridge by two curved segments of the clip comprising proximal ends of a pair of branches of the clip separated by a cut-out.

5. The holding device according to claim 4, wherein the at least one clip is inclined at a predetermined angle relative to the bottom plane of the base when no card or note is disposed in the housing.

6. The holding device according to claim 5, wherein the housing is substantially rectangular in plan view and length of the housing is predetermined so that cards that are completely inserted into and disposed in the housing protrude from the front end of the housing with a predetermined overhang.

7. The holding device according to claim 6, wherein width of the housing is predetermined so that notes disposed in the housing protrude from the housing with a predetermined overhang over the side ridge having the lower height.

8. The holding device according to claim 7, wherein width of the cut-out into which the free end of the at least one clip extends is substantially larger than width of the at least one clip.

9. The holding device according to claim 8, wherein area of the cut-out into which the free end of the at least one clip extends is at least half an area bounded by the side ridges, the front end of the housing and the connecting ridge.

10. The holding device according to claim 9, wherein the base comprises lateral base sections, between which the cut-out is located.

11. The holding device according to claim 10, wherein width of each of the lateral base sections is less than height of the higher side ridge.

12. The holding device according to claim 11, further comprising a cover detachably connected to the housing.

13. The holding device according to claim 12, wherein the tab-accommodating structure comprises a clearance or a groove, in which the tab is secured.

14. The holding device according to claim 12, comprising an interchangeable set of the covers of different appearance, each of the covers being detachably connectable to the housing.

15. The holding device according to claim 12, wherein the cover is flexible.

16. The holding device according to claim 12, wherein the detachable connection of the cover to the housing comprises at least one of a connecting body of the cover connecting with a connecting element on the body and a tab of the cover secured in a tab-accommodating structure of the housing, or a groove of the housing in which a portion of the cover is secured by an insertion body received in the groove along with the portion of the cover.

17. The holding device according to claim 1, wherein the at least one clip extends from the connecting ridge and bends to extend through the open top plane downward between the first and second side ridges.

18. The holding device of claim 17, wherein the base is configured so that each one of said first side ridge and second side ridge project upwards to a distal end which does not extend laterally into the open top plane, said distal end and said at least one clip being adapted so that an uppermost surface of a stack of said cards and/or notes being held by the holding device is covered in the top plane only by said at least one clip.

19. The holding device according to claim 1, wherein the base is open ended at an end opposite the connecting ridge so that said cards extend beyond said base at said open-ended opposite end.

20. A holding device for cards and/or notes, comprising a housing, the housing including at least one clip and a base, wherein the base has an open top plane, a bottom plane having a cut-out area, a first side ridge and a second side ridge projecting upwardly from the bottom plane of the housing, and a connecting ridge at one end of the bottom plane projecting upwardly from the bottom plane;

wherein the at least one clip extends from the connecting ridge and bends to extend through the open top plane downward between the first and second side ridges;

wherein, when the holding device has no cards or notes disposed in the housing, a free end of the at least one clip is received in the cut-out area of the bottom plane; and wherein the base is configured so that each one of said first side ridge and second side ridge project upwards to a distal end and does not extend laterally into the open top plane, said distal end and said at least one clip being adapted so that an uppermost surface of a stack of said cards and/or notes being held by the holding device is covered only by said at least one clip.

21. The holding device according to claim 20, wherein the base is open ended at an end opposite the connecting ridge so that said cards extend beyond said base as said open-ended opposite end.

* * * * *